US008448310B2

(12) United States Patent
Vincent

(10) Patent No.: US 8,448,310 B2
(45) Date of Patent: May 28, 2013

(54) CIRCULAR NEEDLING TABLE FOR NEEDLING A TEXTILE STRUCTURE MADE FROM AN ANNULAR FIBER PREFORM

(75) Inventor: Delecroix Vincent, Vernaison (FR)

(73) Assignee: Messier-Bugatti-Dowty, Velizy-Villacoublay (FR)

( * ) Notice: Subject to any disclaimer, the term of this patent is extended or adjusted under 35 U.S.C. 154(b) by 244 days.

(21) Appl. No.: 12/976,536

(22) Filed: Dec. 22, 2010

(65) Prior Publication Data

US 2011/0154629 A1 Jun. 30, 2011

(30) Foreign Application Priority Data

Dec. 23, 2009 (FR) ..... 09 59469

(51) Int. Cl.
*D04H 18/00* (2012.01)

(52) U.S. Cl.
USPC ..... 28/107; 28/115

(58) Field of Classification Search
USPC ..... 28/107, 108, 109, 110, 111, 112, 28/113, 114, 115, 103, 125
See application file for complete search history.

(56) References Cited

U.S. PATENT DOCUMENTS

| | | | | |
|---|---|---|---|---|
| 3,391,436 | A * | 7/1968 | Fehrer | 28/107 |
| 5,217,770 | A * | 6/1993 | Morris et al. | 428/36.3 |
| 5,513,423 | A * | 5/1996 | Jakob et al. | 28/107 |
| 5,609,707 | A * | 3/1997 | Bazshushtari et al. | 156/148 |
| 6,009,605 | A * | 1/2000 | Olry et al. | 28/107 |
| 6,174,594 | B1 * | 1/2001 | Smith et al. | 428/218 |
| 6,183,583 | B1 * | 2/2001 | Duval et al. | 156/148 |
| 6,347,440 | B1 * | 2/2002 | Duval et al. | 28/107 |
| 6,363,593 | B1 * | 4/2002 | Duval et al. | 28/107 |
| 6,374,469 | B1 * | 4/2002 | Baudry et al. | 28/107 |
| 6,767,602 | B1 * | 7/2004 | Duval et al. | 428/36.1 |
| 7,251,871 | B2 * | 8/2007 | Delecroix et al. | 28/107 |
| 2005/0235471 | A1 * | 10/2005 | Delecroix | 28/107 |
| 2011/0275266 | A1 * | 11/2011 | Lecostaouec | 442/240 |

FOREIGN PATENT DOCUMENTS

| | | |
|---|---|---|
| EP | 0 849 389 | 6/1998 |
| FR | 2 754 031 | 4/1998 |
| WO | WO 97/20092 | 6/1997 |
| WO | WO 98/27026 | 6/1998 |
| WO | WO 98/36187 | 8/1998 |
| WO | WO 98/49382 | 11/1998 |
| WO | WO 02/088449 | 11/2002 |
| WO | WO 02/088450 | 11/2002 |
| WO | WO 02/088451 | 11/2002 |

* cited by examiner

*Primary Examiner* — Amy Vanatta
(74) *Attorney, Agent, or Firm* — Pillsbury Winthrop Shaw Pittman, LLP

(57) ABSTRACT

A circular needling table for needling a textile structure made from an annular fiber preform, the table including: a horizontal annular platen for having the annular fiber preform placed thereon; drive means for driving the fiber preform in rotation about the axis of the platen; a needling device having a needling head extending over an angular sector of the platen and driven in vertical motion relative to the platen; and guide means for guiding the fiber preform under the needling head.

11 Claims, 5 Drawing Sheets

FIG.1
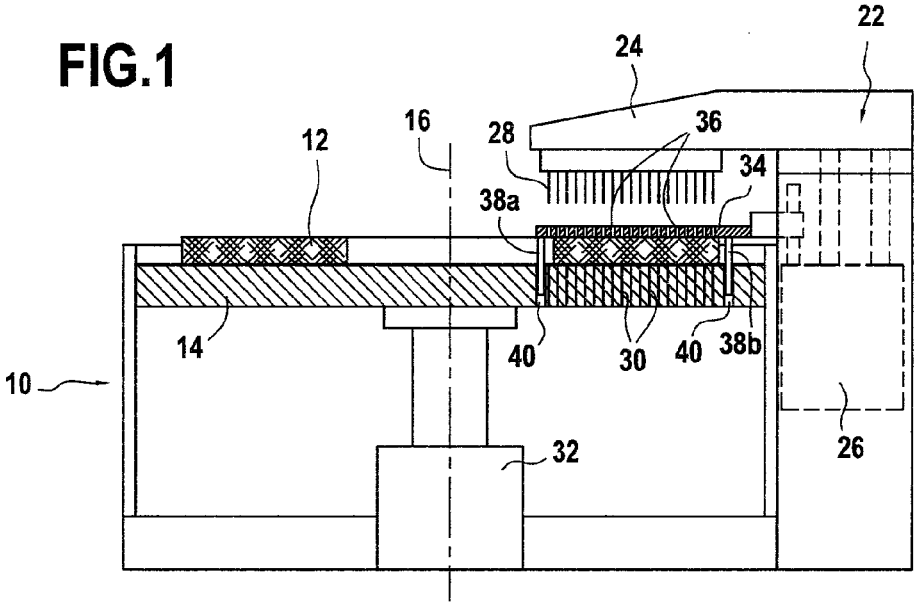
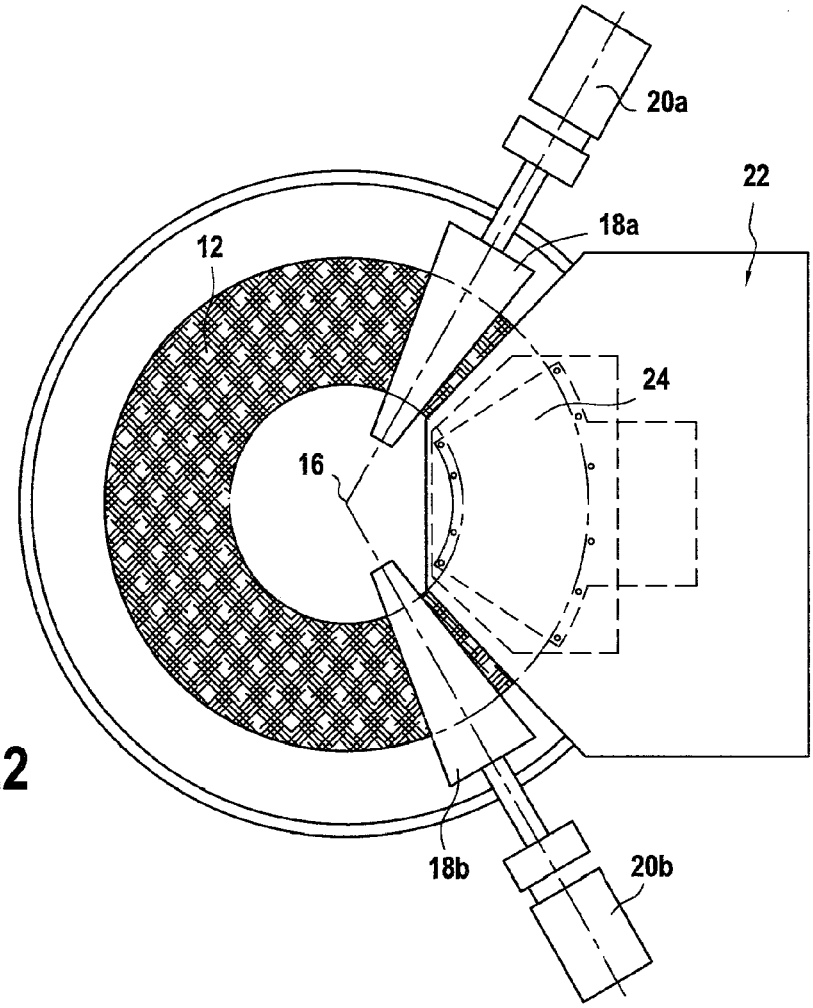
FIG.2

FIG.6A
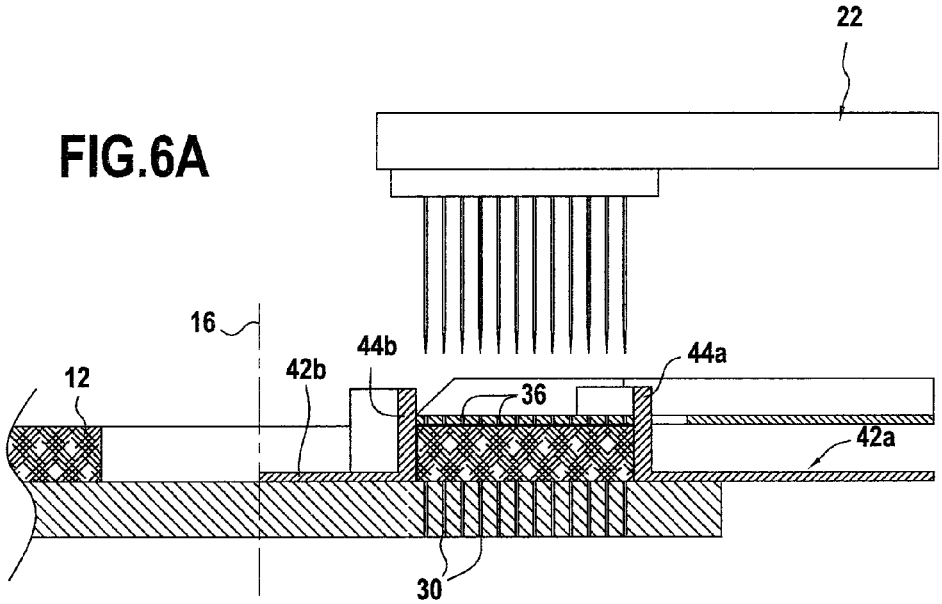
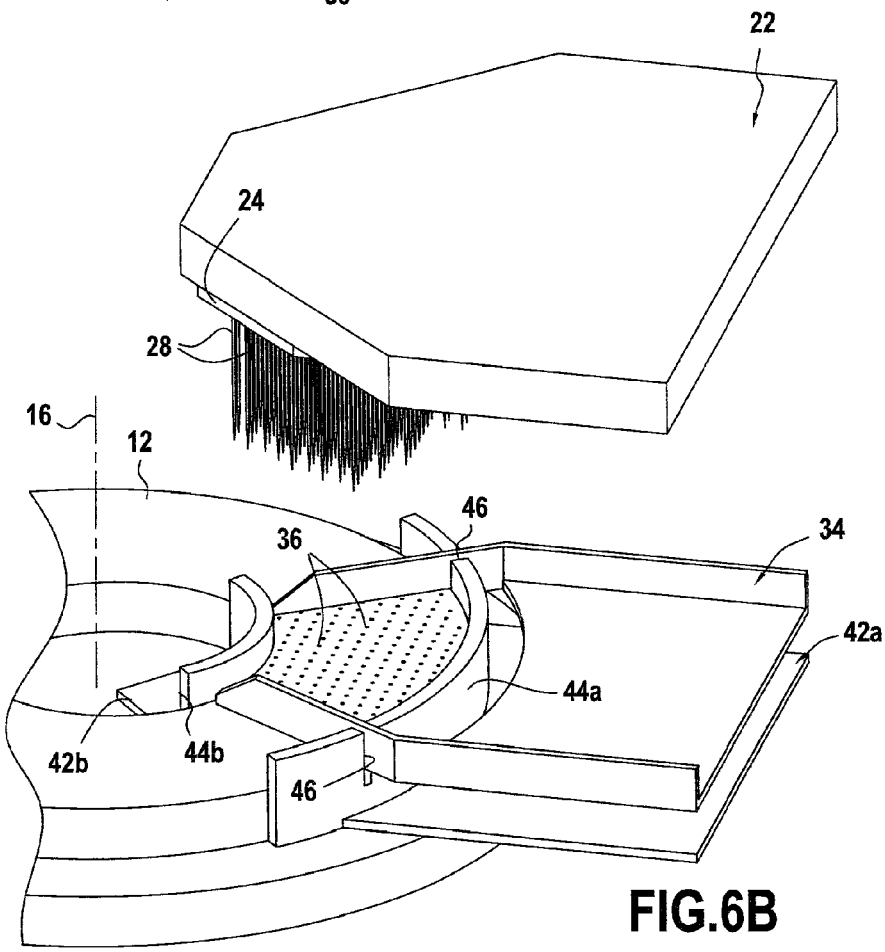
FIG.6B

FIG.7
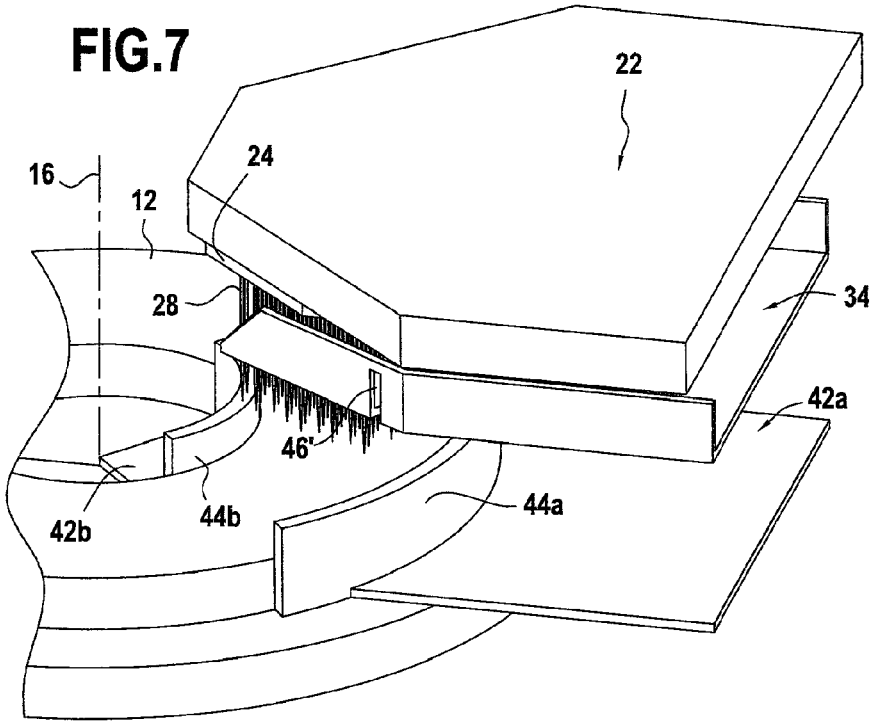
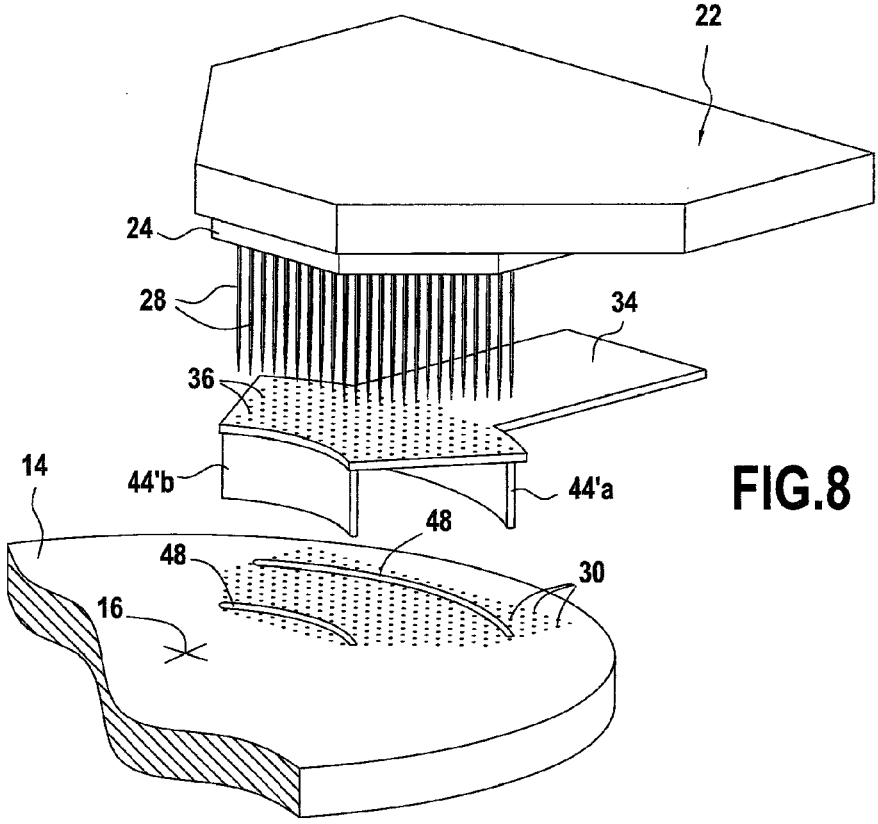
FIG.8

CIRCULAR NEEDLING TABLE FOR NEEDLING A TEXTILE STRUCTURE MADE FROM AN ANNULAR FIBER PREFORM

CROSS-REFERENCE TO RELATED APPLICATIONS

This application is based upon and claims the benefit of priority from French Patent Application No. 09/59469, filed Dec. 23, 2009, the entire content of which is incorporated herein by reference.

BACKGROUND OF THE INVENTION

The present invention relates to the general field of circular needling tables for making a needled textile structure from an annular fiber preform.

It is known to use a needling table of circular type for fabricating annular textile structures that are to constitute the fiber reinforcement of annular parts made of composite material, in particular brake disks, such as the disks made of carbon/carbon (C/C) composite material for airplane brakes.

A circular needling table generally includes a horizontal annular platen on which an annular fiber preform is placed, drive means (usually friction drive means) for driving the fiber preform in rotation about the axis of the platen, and a needling device having a needling head that extends over an angular sector of the platen and that is driven with vertical reciprocating motion relative to the platen. Reference may be made to document WO 02/088451, which describes an embodiment of such a needling table.

With such a table there is a problem of positioning the first layer of the fiber preform under the needling head, given that the first layer is floppy. The same applies to the following layers if they are not properly aligned under the needling head, such that the resulting textile structure generally presents edges that are not properly continuous and clean. In addition, on passing under the needling head, the material tends to spread out towards the edges (creep phenomenon).

OBJECT AND SUMMARY OF THE INVENTION

A main object of the present invention is thus to mitigate such drawbacks by proposing a needling table that makes it possible to obtain a textile structure with edges that are perfectly clean and to avoid the material being subject to creep.

This object is achieved by means of a circular needling table for needling a textile structure made from an annular fiber preform, the table comprising: a horizontal annular platen for having the annular fiber preform placed thereon; drive means for driving the fiber preform in rotation about the axis of the platen; and a needling device having a needling head extending over an angular sector of the platen and driven in vertical motion relative to the platen, and further comprising, in accordance with the invention, guide means for guiding the fiber preform under the needling head.

The presence of guide means for guiding the fiber preform under the needling head makes it possible to ensure that the first layer is accurately positioned thereunder. Similarly, the following layers of the fiber preform stack correctly one on another. As a result, the textile structure that is obtained presents edges that are clean and it is possible to avoid any phenomenon of the material creeping.

In an embodiment, the needling table includes guide members for guiding the fiber preform, which members are secured to a plate that constitutes a stripper interposed between the needling head and the platen.

In this embodiment, the guide members may be formed by pins that extend vertically from the stripper towards the platen and that are positioned angularly in such a manner as to form outer and inner guidance for the fiber preform. Under such circumstances, the platen advantageously includes holes, each located in register with one of the guide pins of the stripper. Alternatively, the guide members may be formed by inner and outer walls that extend vertically from the stripper towards the platen.

In another embodiment, the needling table includes inner and outer vertical walls for guiding the fiber sheet, which walls are secured to the platen and are positioned angularly so as to provide outer and inner guidance for the fiber preform.

In this other embodiment, the needling table may further comprise a plate forming a stripper interposed between the needling head and the platen, the outer guide wall for guiding the fiber preform or the stripper having vertical notches to enable the stripper to be lowered.

BRIEF DESCRIPTION OF THE DRAWINGS

Other characteristics and advantages of the present invention appear from the following description made with reference to the accompanying drawings that show embodiments having no limiting character. In the figures:

FIGS. 1 and 2 are diagrams showing a circular needling table in an embodiment of the invention, respectively in side view and in plan view;

FIGS. 6A and 6B are views of the needling table of FIGS. 5A and 5B in another position, seen respectively in side view and in perspective; and FIGS. 7 and 8 show other variant embodiments of a circular needling table of the invention.

DETAILED DESCRIPTION OF EMBODIMENTS

Figure 3:
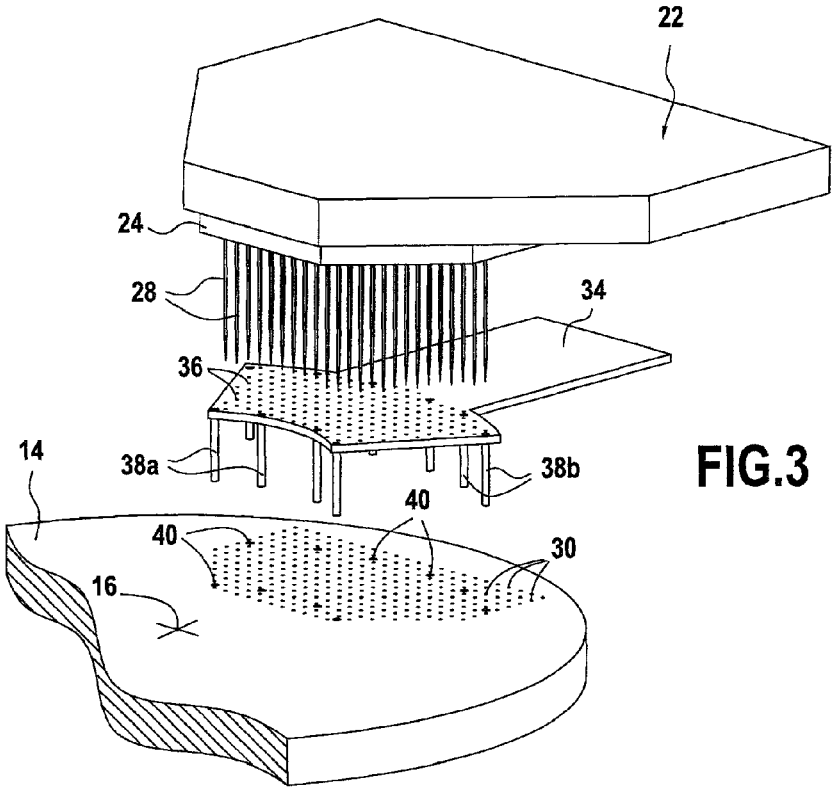
FIGS. 3 and 4 are perspective views of the needling device of the table of FIGS. 1 and 2 in two different positions.

A circular needling table 10 in a first embodiment of the invention is shown in highly diagrammatic manner in FIGS. 1 and 2.

The invention applies to any circular needling process in which annular textile layers (or plies) are stacked and needled on a platen to form a needled fiber preform of annular shape. The layers may be formed beforehand as rings or annular sectors that are juxtaposed and cut out from a woven fabric or a non-woven material made up of unidirectional or multidirectional fibers. They may also be formed as turns wound flat from a feed device such as that described in patent application WO 02/088449, or by turns formed from deformed braids, or indeed by turns formed from a deformable two-dimensional texture (a helical fabric or braid).

The fibrous annular preform 12 for needling rests directly on a horizontal annular platen 14 of the needling table. It is driven in rotation about a vertical axis 16 by a set of conical rollers 18*a*, 18*b* that are kept permanently in contact with the annular preform. This set may comprise two conical rollers spaced apart by 120° and each actuated by an independent gear-motor unit 20*a*, 20*b*. Nevertheless, common drive coupled to an appropriate transmission could also be envisaged.

The annular preform 12 set into rotation in this way moves past a needling device 22 that comprises in particular a needling head 24 overlying a predetermined angular sector of the horizontal platen 14. This needling head is driven with vertical reciprocating motion relative to the platen 14 by means of an appropriate drive device 26 (e.g. of the crank and connecting rod type).

The needling head 24 carries a determined number of needles 28 that are fitted with barbs, hooks, or forks for taking hold of fibers in the stacked layers of the annular preform and for transferring them through the layers when the needles penetrate into the preform. For this purpose, the platen 14 of the needling table has a series of vertical perforations 30 located in register with the needles 28 of the needling head so as to allow them to pass while they are needling the first layers of the annular preform. Furthermore, each time a new ply is needled, the platen of the needling table is moved vertically by appropriate drive means 32 through a downward step of determined size corresponding to the thickness of one needled layer.

Figure 4:
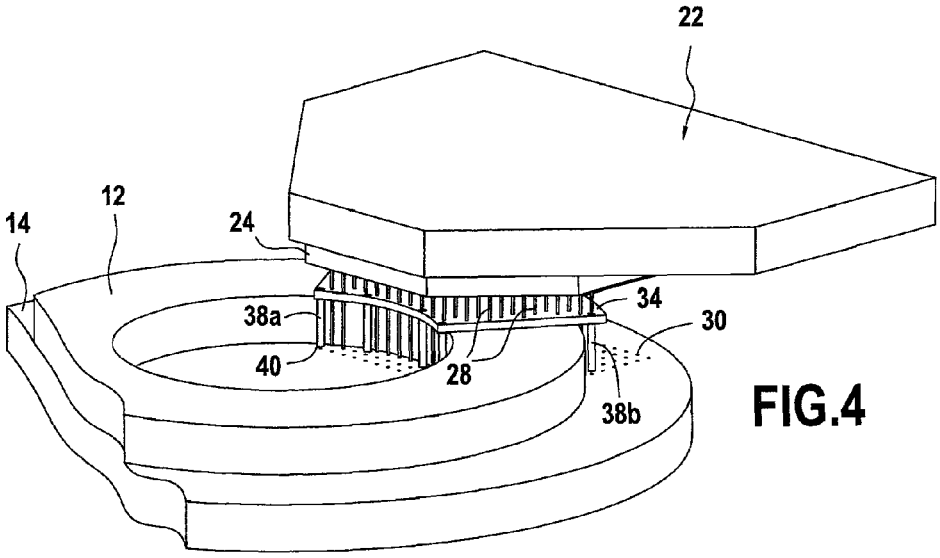
Figure 5A:
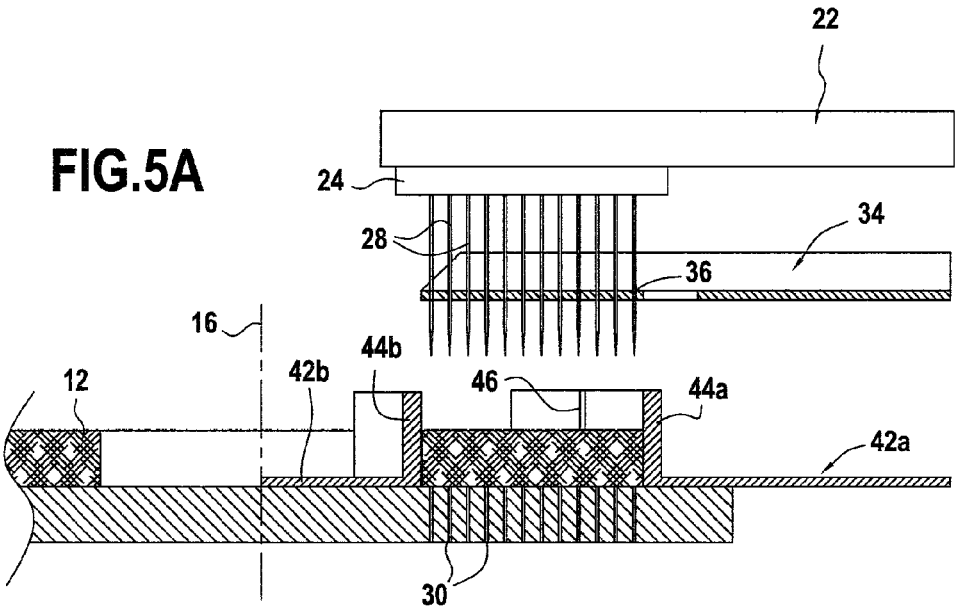
FIGS. 5A and 5B are diagrams showing a circular needling table in another embodiment of the invention seen respectively in side view and in perspective.
Figure 5B:
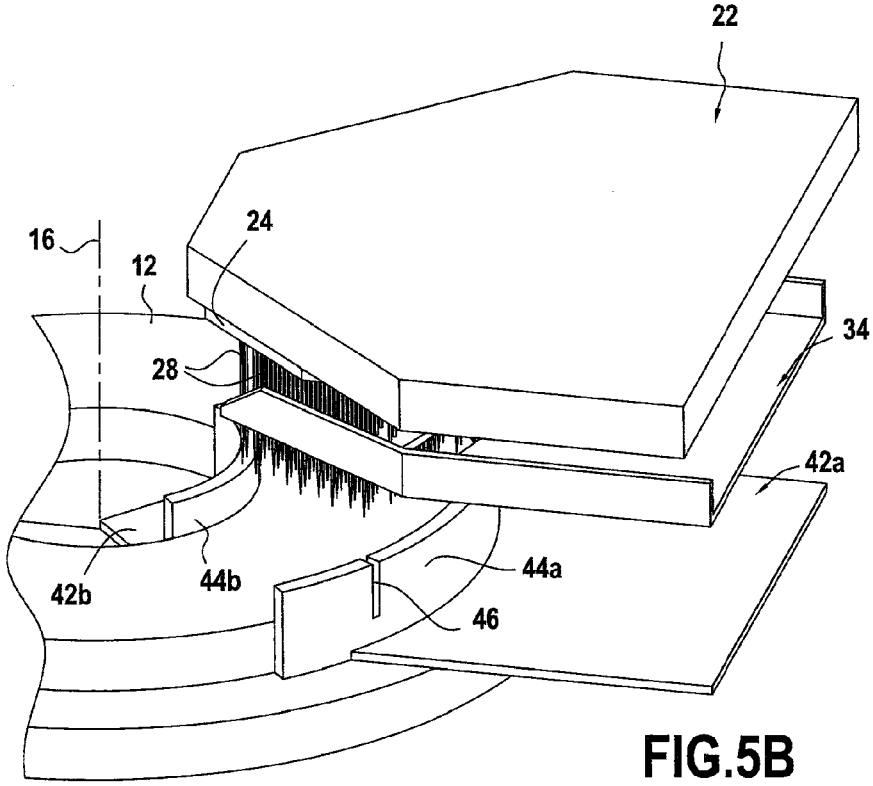

Furthermore, as shown more precisely in FIGS. 3 and 4, the needling device 22 also includes a plate forming a stripper 34, which plate is interposed between the needling head 22 and the platen 14.

The stripper performs the function of holding in place a portion of the annular preform situated under the needling head, while the needles 28 pass therethrough. For this purpose, the stripper 34 is suitable for being moved vertically relative to the platen 14, e.g. by means of the drive device 26 for driving the needling head. This movement is synchronized with the movement of the needling head so that the stripper 34 is lowered and pressed against the portion of annular preform that is situated beneath the needling head while the needles are passing through (as shown in FIG. 4). Furthermore, the stripper includes a series of perforations 36 passing through it and located in register with the needles 28 of the needling head so that they pass therethrough while needling the plies of the annular preform.

According to the invention, means are also provided for guiding the annular preform 12 under the needling head 24.

In a first embodiment of these guide means, as shown in FIGS. 1 to 4, the stripper 34 has guide pins 38*a*, 38*b* extending vertically from its inside face towards the platen 14 and angularly positioned so as to provide external and internal guidance of the annular preform.

As shown in particular in FIG. 3, the stripper 34 may comprise for example four inner pins 38*a* defining a circular arc centered on the vertical axis 16 on the inside, and six outer pins 38*b* defining a circular arc centered on the axis 16 on the outside. These inner and outer pins define between them a path through which the annular preform passes under the needling head. Thus, when the stripper is lowered and pressed against the annular preform (FIG. 4), the preform is accurately positioned under the needling head before it is applied thereto.

Furthermore, the platen 14 includes a series of holes 40, each located in register with a respective one of the guide pins 38*a*, 38*b* of the stripper 34 so that they can pass into the holes when the stripper is lowered.

By way of example, the guide pins 38*a*, 38*b* are made of metal and are welded to the stripper that is also made of metal. Depending on the dimensions of the annular preform for needling, and in particular on its width, it is possible to adjust the spacing between the inner pins and the outer pins so as to adapt it to the dimensions of the preform by changing the stripper.

FIGS. 5A-5B and 6A-6B show a second embodiment of these guide means. In this second embodiment, the various elements of the needling table that are identical to those described with reference to the first embodiment are given the same references.

Furthermore, the horizontal platen 14 of the needling table here has vertical walls for guiding the annular preform, which walls are positioned angularly so as to form outer and inner guidance of the preform.

More precisely, the platen carries an outer horizontal plate 42*a* having mounted at the end thereof an outer guide wall 44*a* that extends vertically from the outer plate towards the needling head 24. The platen also carries an inner horizontal plate 42*b* having mounted at the end thereof an inner guide wall 44*b* that extends vertically from the inner plate towards the needling head. These walls 44*a*, 44*b* provide outer guidance and inner guidance for the portion of the annular preform that is positioned under the needling head. Furthermore, these guide walls are stationary relative to the horizontal platen 14.

To allow the stripper to be lowered, the outer guide wall 44*a* may include vertical notches 46 for passing the edges of the plate forming the stripper (FIGS. 5A-5B, 6A-6B). Alternatively, in a variant embodiment shown in FIG. 7, the edges of the plate forming the stripper may include such vertical notches 46' so as to allow it to be lowered.

FIG. 8 shows yet another variant embodiment of a circular needling table in which the vertical walls 44'*a*, 44'*b* for guiding the preform under the needling head 24 are secured to the stripper 34 (instead of to the platen): these walls extend vertically from the plate forming the stripper towards the platen 14 of the table. Furthermore, openings 48 of shape complementary to the guide walls 44'*a*, 44'*b* are formed in the platen facing the walls so as to enable the stripper to be lowered.

Finally, as a function of the dimensions of the annular preform to be needled, and in particular as a function of its width, it is possible to adjust the spacing between the outer guide wall and the inner guide wall so as to adapt to the dimensions of the preform by changing the spacing between the outer and inner walls and by modifying the radii of curvature of the outer and inner walls.

What is claimed is:

1. A circular needling table for needling a textile structure made from an annular fiber preform, the table comprising:

a horizontal annular platen for having the annular fiber preform placed thereon;

drive means for driving the fiber preform in rotation about the axis of the platen; and a needling device having a needling head extending over an angular sector of the platen and driven in vertical motion relative to the platen;

guide members for guiding the fiber preform under the needling head, wherein the guide members are secured to a plate that constitutes a stripper interposed between the needling head and the platen.

2. A table according to claim 1, wherein the guide members are formed by pins that extend vertically from the stripper towards the platen and that are positioned angularly in such a manner as to form outer and inner guidance for the fiber preform.

3. A table according to claim 2, wherein the platen includes holes, each located in register with one of the guide pins of the stripper.

4. A table according to claim 1, wherein the guide members are formed by inner and outer walls that extend vertically from the stripper towards the platen.

5. A table according to claim 1, wherein the drive means include a motor configured to actuate a roller configured to contact the annular fiber preform.

6. A circular needling table for needling a textile structure made from an annular fiber preform, the table comprising:

a horizontal annular platen for having the annular fiber preform placed thereon;

drive means for driving the fiber preform in rotation about the axis of the platen;

a needling device having a needling head extending over an angular sector of the platen and driven in vertical motion relative to the platen;

guide members for guiding the fiber preform under the needling head, wherein the guide members include inner and outer vertical walls for guiding the fiber preform, which walls are secured to the platen and are positioned angularly so as to provide outer and inner guidance for the fiber preform; and a plate forming a stripper interposed between the needling head and the platen, the outer guide wall for guiding the fiber preform or the stripper having vertical notches to enable the stripper to be lowered.

7. A table according to claim 6, wherein the drive means include a motor configured to actuate a roller configured to contact the annular fiber preform.

8. A circular needling table for needling a textile structure made from an annular fiber preform, the table comprising:

a horizontal annular platen for having the annular fiber preform placed thereon;

a driver unit configured to drive the fiber preform in rotation about the axis of the platen;

a needling device having a needling head extending over an angular sector of the platen and configured to be driven in vertical motion relative to the platen;

a guide member configured to guide the fiber preform under the needling head, wherein the guide member is secured to a plate that constitutes a stripper interposed between the needling head and the platen.

9. A table according to claim 8, wherein the guide member includes a plurality of pins that extend vertically from the stripper towards the platen and that are positioned angularly in such a manner as to form outer and inner guidance for the fiber preform.

10. A table according to claim 8, wherein the guide member includes inner and outer walls that extend vertically from the stripper towards the platen.

11. A table according to claim 8, wherein the driver unit includes a motor configured to actuate a roller configured to contact the annular fiber preform.

* * * * *